United States Patent [19]

Beard et al.

[11] Patent Number: 4,858,882

[45] Date of Patent: Aug. 22, 1989

[54] BLOWOUT PREVENTER WITH RADIAL FORCE LIMITER

[76] Inventors: Joseph O. Beard, 1025 N. Lincoln Ave., Fullerton, Calif. 92631; Stanley W. Granger, 23800 Gold Nugget, Diamond Bar, Calif. 91765; Frode Sveen, 12697 Orgren Ave., Chino, Calif. 91710

[21] Appl. No.: 273,738

[22] Filed: Nov. 18, 1988

Related U.S. Application Data

[63] Continuation of Ser. No. 54,932, May 27, 1987, abandoned.

[51] Int. Cl.[4] ..... E21B 33/06

[52] U.S. Cl. ..... 251/1.2; 277/235 R

[58] Field of Search ..... 251/1.1, 1.2; 277/235 R

[56] References Cited

U.S. PATENT DOCUMENTS

| | | | |
|---|---|---|---|
| 3,323,773 | 6/1967 | Walker | 251/1.2 |
| 3,667,721 | 6/1972 | Vujasinovic | 251/1.1 |
| 4,460,149 | 7/1984 | Schaeper et al. | 251/1.2 |

*Primary Examiner*—John Fox

*Attorney, Agent, or Firm*—William L. Chapin

[57] ABSTRACT

An oil well blowout preventer has a housing with axially aligned entrance and exit pipe casing bores and a coaxially aligned hemispherical cavity in the upper portion of the housing. A ring-shaped, convex upper surface sealing member fits conformally within the hemispherical cavity and is drivable upwards by a hollow, hydraulically actuated piston coaxially encompassing the lower exit bore of the housing. The upper annular surface of the piston is beveled downwards and inwards to mate with the bottom annular surface of the sealing member. The sealing member is comprised of incompressible, tooth-like elements imbedded in a resilient matrix. Force limiting means in the sealing member prevent damagingly large radial impact forces of the teeth-like elements with drill string components disposed longitudinally within the device. In one embodiment, resilient material is interposed between the actuating piston and the incompressible element to limit impact force. In another embodiment, the incompressible element of the sealing member are made up of parts movable with respect to one another, to limit impact force.

31 Claims, 9 Drawing Sheets

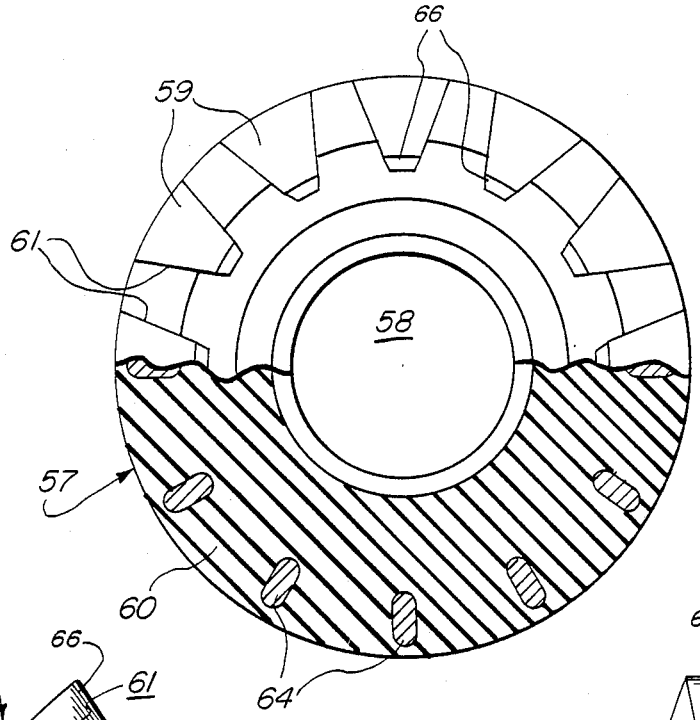
FIG. 2
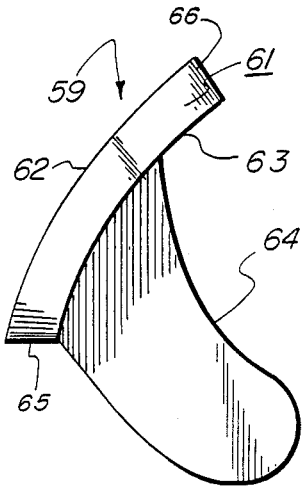
FIG. 3
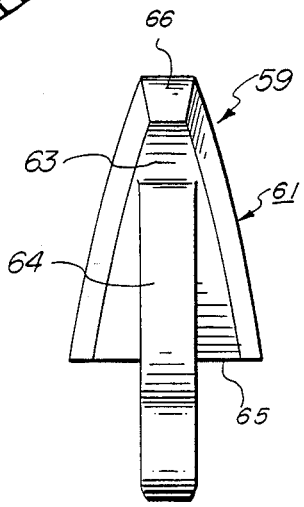
FIG. 4
FIG. 5
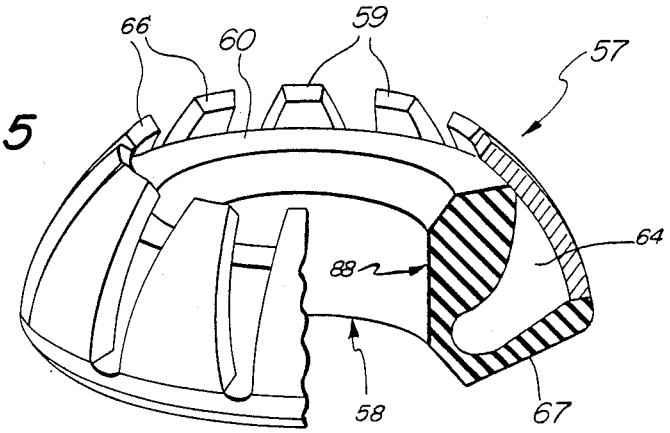

FIG. 10
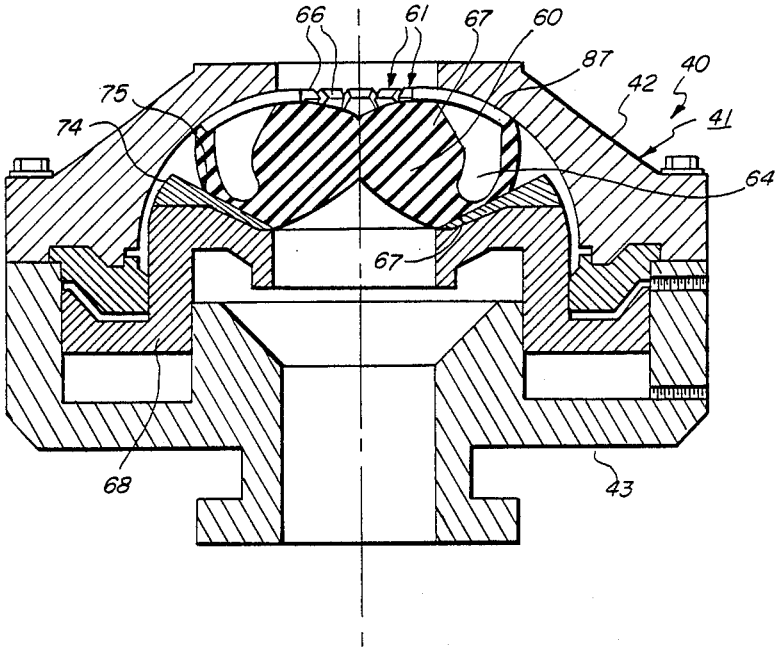
FIG. 11
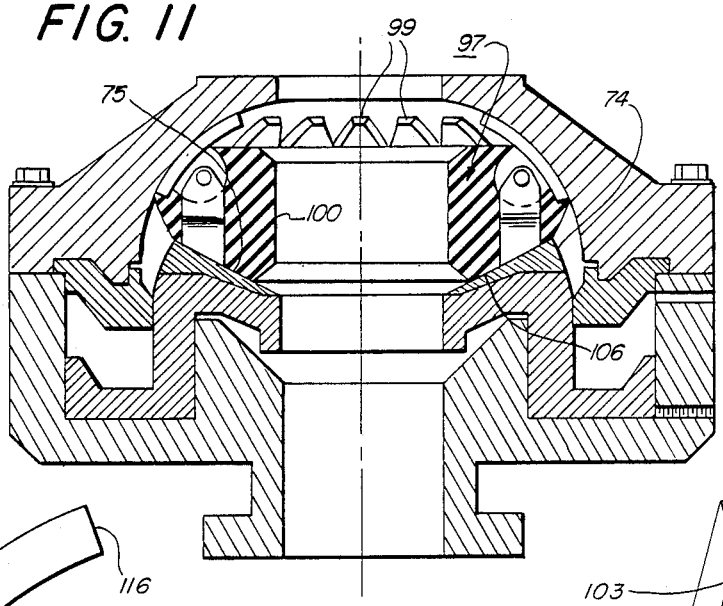
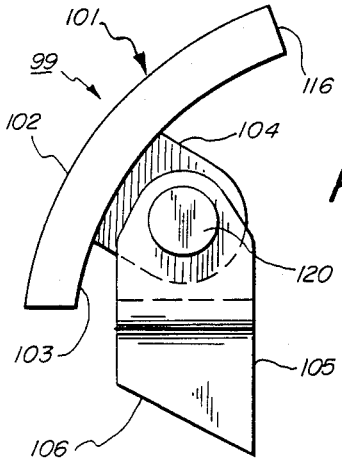
FIG. 12
FIG. 13
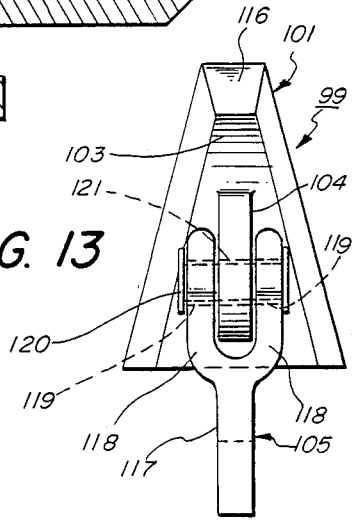

FIG. 28
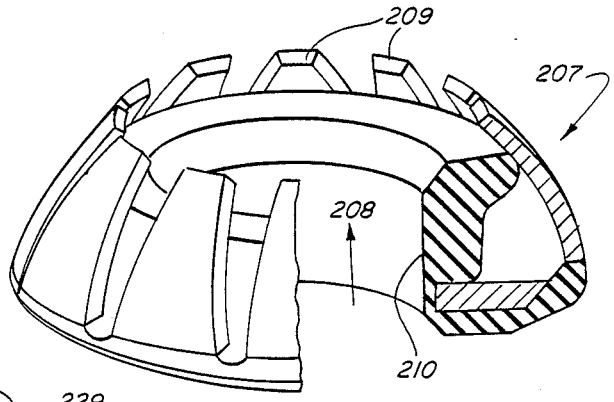
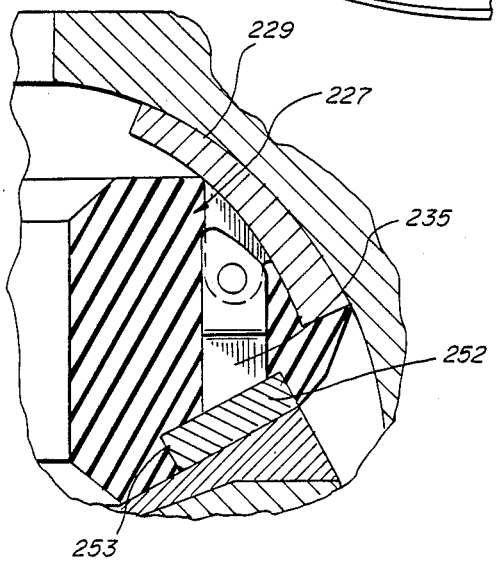
FIG. 29
FIG. 30
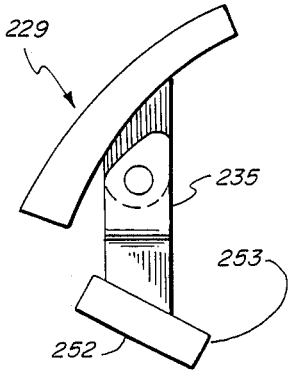
FIG. 31
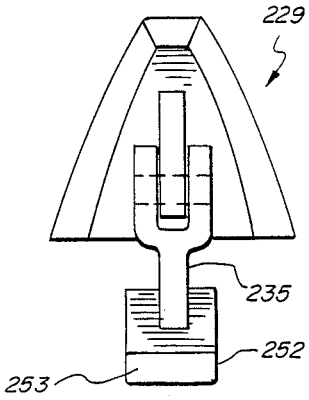

BLOWOUT PREVENTER WITH RADIAL FORCE LIMITER

This is a continuation of application of Ser. No. 07/054,932 filed 5/27/87, now abandoned.

BACKGROUND OF THE INVENTION

A. Field of the Invention

The present invention relates to apparatus for use in oil well drilling operations. More particularly, the invention relates to mechanisms for preventing pressurized subsurface liquids or gases from blowing out and upwards through a well hole.

B. Discussion of Background Art

In drilling for natural gas or liquid petroleum, a drill string consisting of many lengths of threaded pipes screwed together and terminated by a drill bit head is used to bore through rock and soil. The drill bit head has a larger diameter than the pipes forming the drill string above it. The upper end of the drill string is rotated to transmit a rotary boring action to the drill bit head.

A specially formulated mud is introduced into an opening in an upper drill pipe, flowing downward through the hollow interior of the pipes in the drill string and out through small holes or jets in the drill bit head. Since the drill bit head has a larger diameter than the drill string above it, an elongated annular space is created during the drilling process which permits the mud to flow upwards to the surface. The purpose of the mud is to lubricate the rotating drill string, and to provide a downward hydrostatic pressure which counteracts pressure which might be encountered in subsurface gas pockets.

In normal oil well drilling operations, it is not uncommon to encounter subsurface gas pockets whose pressure is much greater than could be resisted by the hydrostatic pressure of the elongated annular column of drilling mud. To prevent the explosive and potentially dangerous and expensive release as gas and/or liquid under pressure upwards out through the drilling hole, blowout preventers are used. Blowout preventers are mounted in a pipe casing surrounding a drill hole, near the upper end of the hole.

Typical blowout preventers have a resilient sealing means which can be caused to tightly grip the outer circumferential surfaces of various diameter drill string components, preventing pressure from subterranean gas pockets from blowing out material along the drill string. Usually, the resilient sealing means of a blowout preventer is so designed as to permit abutting contact of a plurality of individual sealing segments, when all elements of a drill string are removed from the casing. This permits complete shutoff of the well, even with all drill string elements removed. Most oil well blowout preventers are remotely actuatable, as by a hydraulic pressure source near the drill hole opening having pressure lines running down to the blowout preventer.

Blowout preventers having resilient sealing means are disclosed in U.S Pat. No. 3,323,773, R. W. Walker, June 6, 1967, and U.S. Pat. No. 3,667,721, issued June 6, 1972 to A. N. Vujasinovic.

Prior blowout preventers, including those disclosed in the above-identified U.S. patents, typically use a circularly spaced array of curved metal segments which are contained slidably in a hemispherical cavity and pushed upwards by a hydraulic piston to effect a reduction in diameter of an upward entrance bore to the spherical cavity, through which drill string components are inserted. The curved metal segments are held in a circumferentially spaced relationship by being molded integrally into a resilient rubber matrix having a generally cylindrical interior shape. When the sealing element comprising the curved metal segments and resilient matrix are moved upwards, the inner cylindrical rubber surface is forced to cold flow inwards towards the outer circumferential surface of the drill string components within the blowout preventer, thereby effecting a seal and preventing pressurized fluids below the blowout preventer from escaping upwards. In some prior art blowout preventers, sufficient movement of rubber inwards is afforded to completely seal the bore through the blowout preventer, even with all drill string components withdrawn.

Existing blowout preventers can damage drill string components under certain conditions. Since the metal segments used in the sealing element of some blowout preventers are non-resiliently translated upwards and inwards by the actuator piston, the upper inner edges of the segments can contact the circumferential surface of drill string components with radial compressive forces sufficient to damage the component. With this and other limitations of existing blowout preventers in mind, the present invention was conceived of.

OBJECTS OF THE INVENTION

An object of the present invention is to provide an improved oil well blowout preventer having movable resilient and rigid elements and force-limiting means for preventing the rigid elements from being forced against drill string components sufficiently hard to damage the components.

Another object of the invention is to provide an improved oil well blowout preventer having improved sealing between the resilient elements of the device and an actuating piston used to operate it.

Another object of the invention is to provide an improved oil well blowout preventer device having a greater proportion of resilient material in slidable contact with the walls of the cavity to be sealed, thereby minimizing wear occasioned by metal-to-metal sliding contact between the rigid elements of the device and the cavity walls.

Another object of the invention is to provide an oil well blowout preventer device in which stresses in the resilient elements of the device are reduced as a result of the cooperative interaction of force-limiting means with the resilient and rigid elements of the device.

Various other objects and advantages of the present invention, and its most novel features, will be particularly pointed out in this disclosure.

It is to be understood that although the invention disclosed herein is fully capable of achieving the objects and providing the advantages mentioned, the structural and operational characteristics of the invention described herein are merely illustrative of the preferred embodiments. Accordingly, we do not intend that the scope of our exclusive rights and privileges in the invention be limited to the details of construction and operation described. We do intend that equivalents, adaptations and modifications of the invention which may be reasonably construed to employ the novel concepts of the invention described herein be included within the scope of the invention as defined by the appended claims.

SUMMARY OF THE INVENTION

Briefly stated, the present invention comprehends an improved oil well blowout preventer device of the type employing a piston actuated metal translating means and resilient sealing means within a curved cavity to seal the bore of the cavity around a drill string extending coaxially through the cavity. In the improved oil well blowout preventer device according to the present invention a composite sealing member is moveable within an enclosed housing having a curved inner cavity. Force-limiting means interact cooperatively with movable incompressible and resilient sealing elements of the composite sealing member to prevent damaging impact of the rigid elements with drill string components within the cavity.

In one embodiment of the device according to the present invention, incompressible sealing elements are metal, and are moved in front of resilient elastomeric material interposed in the path extending from an actuating piston to the metal sealing elements and to the outer cylindrical surface of drill string components. The compressibility of the resilient material limits the impact force exertable by the rigid sealing elements against the drill string components.

In another embodiment of the device, metal sealing elements each have two parts, which are moveable with respect to one another, thereby limiting the force with which the metal sealing elements may be moved against the drill string components by the actuating piston.

BRIEF DESCRIPTION OF THE DRAWINGS

FIG. 2 is a fragmentary upper plan view partially taken in section along line 2—2 of the device of FIG. 1.

FIG. 3 is a side elevation view of one of the rigid elements forming part of the sealing element of the device of FIGS. 1 and 2.

FIG. 4 is an inner edge view of the rigid element of of FIG. 3.

FIG. 5 is a fragmentary perspective view of the sealing element forming part of the devices of FIG. 1, with a radial section removed to show the composite structure of the sealing element.

FIG. 10 is a view similar to FIG. 6, but showing diametrically opposed portions of the sealing element in abutting contact, completely sealing off the bore of the blowout preventer device.

FIG. 11 is a fragmentary longitudinal sectional view of a second embodiment of the oil well blowout preventer device according to the present invention.

FIG. 12 is a side elevation view of one of the rigid elements forming part of the sealing element of the device of FIG. 11.

FIG. 13 is an inner edge view of the rigid element of FIG. 12.

FIG. 28 is a fragmentary perspective view of the sealing element forming part of the apparatus of FIG. 24, with a radial section removed to show the composite structure of the sealing element.

FIG. 29 is a fragmentary longitudinal sectional view of a sixth embodiment of an oil well blowout preventer device according to the present invention.

FIG. 30 is a side elevation view of one of the rigid elements forming part of the sealing element of the device of FIG. 29.

FIG. 31 is an inner edge view of the rigid element of FIG. 30.

DESCRIPTION OF THE PREFERRED EMBODIMENTS

Figure 1:
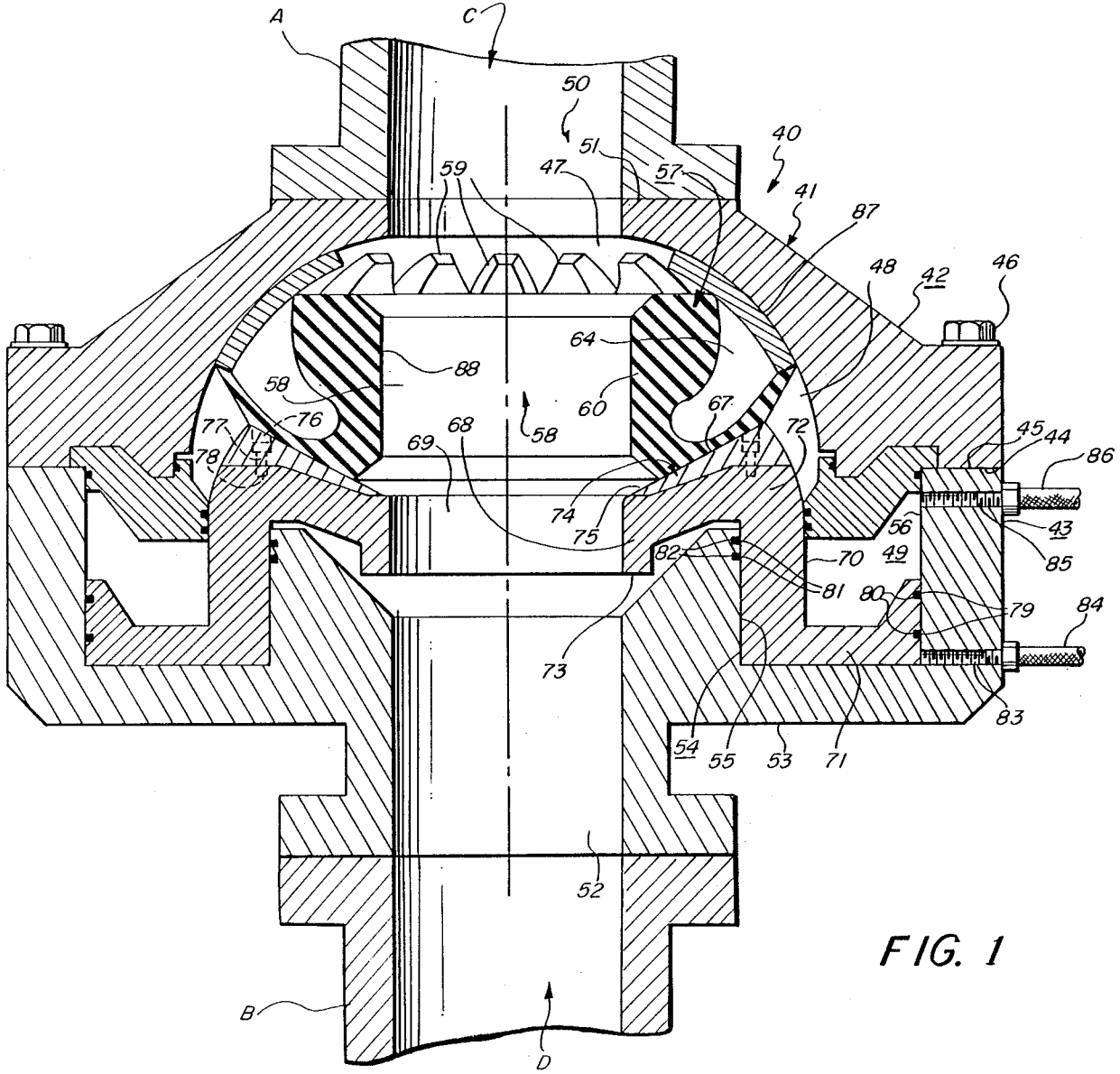
FIG. 1 is a longitudinal sectional view of an oil well blowout preventer device according to the present invention.

Referring now to FIG. 1, an oil well blowout preventer according to the present invention is shown. As shown in FIG. 1, the blowout preventer 40 is adapted to fit in a sealed and coaxially aligned interrelationship between an upper oil well drilling casing A extending upwards to drilling platform, and a lower oil well drilling casing B extending downwards towards an existing or sought after pocket of subterranean or underwater oil or gas.

Blowout preventer 40 includes a housing 41, preferably made of an upper section 42 and a lower section 43. Upper and lower housing sections 42 and 43 have a generally circularly symmetric shape, and are sealingly joined to one another along a transversely disposed lower annular mating surface 44 and transversely disposed to an upper annular mating surface 45, respectively, by bolts 46.

The housing 41 of blowout preventer 40 has a generally circularly symmetric hollow interior space 47, formed of a generally hemispherical interior space 48 in upper housing section 42, and a generally annular shaped interior space 49 in lower housing section 43. A bore 50 in the upper wall 51 of upper housing section 42 is provided to permit communication between the bore C of upper well casing A and the hemispherical interior space 48 of the upper housing section. A bore 52 is provided through the lower wall 53 of lower housing section 43 and through a coaxial boss section 54, which protrudes upwards from the lower wall to form the annular interior space 59. Bore 52 provides communication between bore D of lower well casing B, and the hemispherical interior space 48 of upper housing section 42. The outer cylindrical wall surface 55 of boss 54, and the inner cylindrical wall surface 56 of the lower housing section 43, form an annular interior space 49 in the lower housing section, whose purpose will be described below.

The blowout preventer device 40 according to the present invention includes a sealing element 57 of a generally circularly symmetric shape, and contained within the hemispherical interior 48 in upper housing section 42. Sealing element 57 has a generally cylindrical shaped bore 58 extending longitudinally through it, and is positioned within the hemispherical interior space 48 of upper housing section 42. The bore is in axial alignment with the bore 50 through the upper wall 41 of the upper housing section.

As may be seen best by referring to FIGS. 2 through 5, sealing element 57 is a composite structure, containing curved metal teeth 59 integrally molded into a generally cylindrical matrix 60 made of a resilient material such as rubber or other elastomer.

As may be seen best by referring to FIG. 3, each curved metal tooth 59 includes an upper section 61 that has in edge view the shape of a curved plate having concentric upper and lower surfaces 62 and 63, respectively, and a curved leg or web section 64 extending perpendicularly downwards and inwards from the lower surface of the upper section.

As may be seen best by referring to FIG. 4, the upper plate section 61 of each tooth 59 has in elevation view the general shape of an isoscles-triangular, elevation-view prism having a horizontal base plane 65, and whose vertex is truncated by a horizontally disposed upper surface plane 66. Also as shown in FIG. 4, the leg or web section 64 of each tooth 59 has in edge view the shape of an arcuately curved plate.

As may be best seen by referring to FIGS. 1, 2 and 5, each tooth 59 is retained in the molded resilient matrix 60 at equal circumferential angles, equidistant from the longitudinal center line of the bore 58 through the sealing element 57, thus forming a ring shaped structure having upwardly and inwardly curving outer sides. The resilient matrix 60 has a generally cylindrical shape whose height is less than that of the teeth 59. The legs 64 of the teeth 59 are completely enclosed within the lower portion of the molded matrix 60, which has a bottom wall surface 67 which slopes upwards and outwards from the central base 58 of the molded matrix. The purpose of the sloping wall surface 67 of the molded matrix 60 will now be described.

Referring now to FIG. 1, it may be seen that the blowout preventer 40 according to the present invention includes a circularly symmetric piston 68 having a hollow center bore 69, downward depending cylindrical walls 70, and an annular flange section 71 extending radially outwards in substantially flush alignment with the bottom of the cylindrical wall. The upper surface of the piston 68 has a flat annular ring section 72 which extends radially inwards some distance from the outer surface of the cylindrical wall 70. Beginning at the inner edge of the annular ring section 72, the upper surface of the piston 68 slopes downward and inward to the central bore 69 through a downwardly projecting boss 73.

A metal ring 74 having a flat annular lower, outermost bottom surface, and a downwardly and inwardly sloping inner bottom surface, is adapted to fit conformally to the upper surface of piston 68. Alternatively, ring 74 can be an integral boss projecting upwards from the upper surface of the piston 68. Preferably, the upper surface 75 of the piston ring 74 slopes downwards and inwards at the same angle as the bottom wall surface 57 of the molded matrix 60. The piston ring 74 is attached to the upper surface of piston 68, as for example, by bolts 76 extending downwards through countersunk holes 77 through the upper surface of the piston ring into threaded holes 78 extending downwards into the flat annular ring section 72 on the top of the piston. A shallow, circular groove 74A is provided in the lower surface of the piston ring 74 for a resilient O-ring 74B. Compression of the O-ring 74B assures a pressure tight joint between the piston 68 and the piston ring 74.

As shown in FIG. 1, the lower, annular flange section 71 of the piston 68 fits conformally within the annular interior space 49 of lower housing section 43 of the blowout preventer housing 41. Resilient piston sealing rings 79 are contained in grooves 80 provided in the outer circumferential surface of flange 71 to effect a slidable, pressure-tight seal with the inner circumferential wall surface of the annular interior space 49 of the lower housing section 43. Similarly, resilient piston sealing rings 81 are contained in grooves 82 provided in the inner circumferential wall surface of the annular interior space 49 of the lower housing section 43, to effect a slidable, pressure-tight seal with the inner circumferential surface of the piston 68. A threaded port 83 is provided through the bottom wall surface of lower housing section 43, beneath the annular interior space 49 of the lower housing section, and communicates with that space. Hydraulic pressure in a line 84 connected to port 83 is effective in forcing piston 68 upwards. A second threaded port 85 is provided through the outer cylindrical wall surface of lower housing section 43, adjacent the annular interior space 49 of the lower housing section. The port 85 is positioned above the maximum upward position of the flange section 71 of the piston 68, and communicates with the annular interior space 49. Thus, pressure in a hydraulic line 86 connected to the port 85 is effective in forcing the piston 68 back downwards.

The operation of the oil well blowout preventer 40 illustrated in FIGS. 1 through 5 and described structurally above may be best understood by referring to FIGS. 6 through 10, in conjunction with the following commentary.

As shown in FIGS. 1 and 6 through 10, the sealing element 57 of the oilwell blowout preventer apparatus is contained coaxially within the generally hemispherical interior space 48 of the upper housing section 42 of the apparatus. The sealing element 57 is positioned within the hemispherical interior space of the upper housing section in such a way as to place the curved upper surface 62 of the upper plate section 61 of each tooth 59 of the sealing element in slidable tangent contact with the inner curved surface 87 of the upper housing section 42.

Also, the sloping bottom wall surface 67 of the molded resilient matrix 60 of the sealing element 57 conformally contacts the sloping upper surface 75 of piston ring 74 attached to the upper annular surface of the piston 68.

Figure 6:
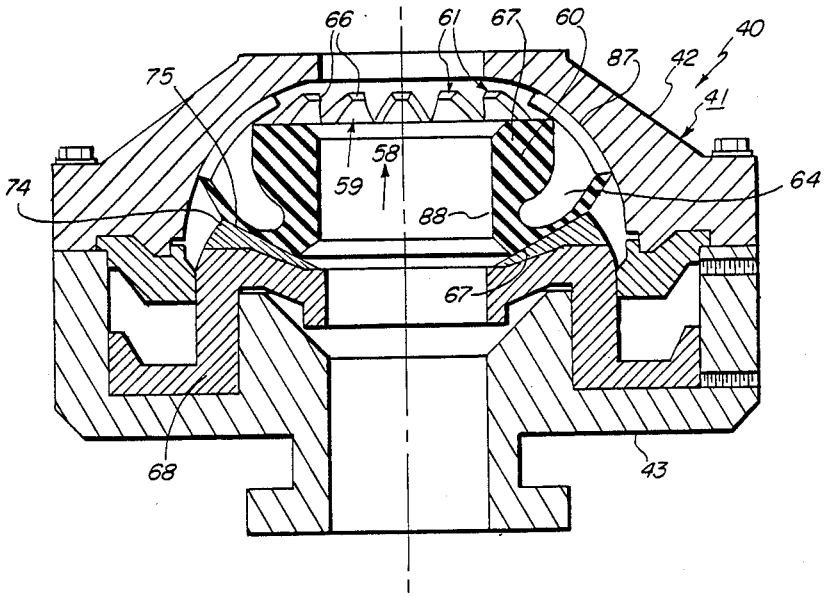
FIG. 6 is a fragmentary longitudinal sectional view of the device of FIG. 1 showing the sealing element of the device in an open position.
Figure 7:
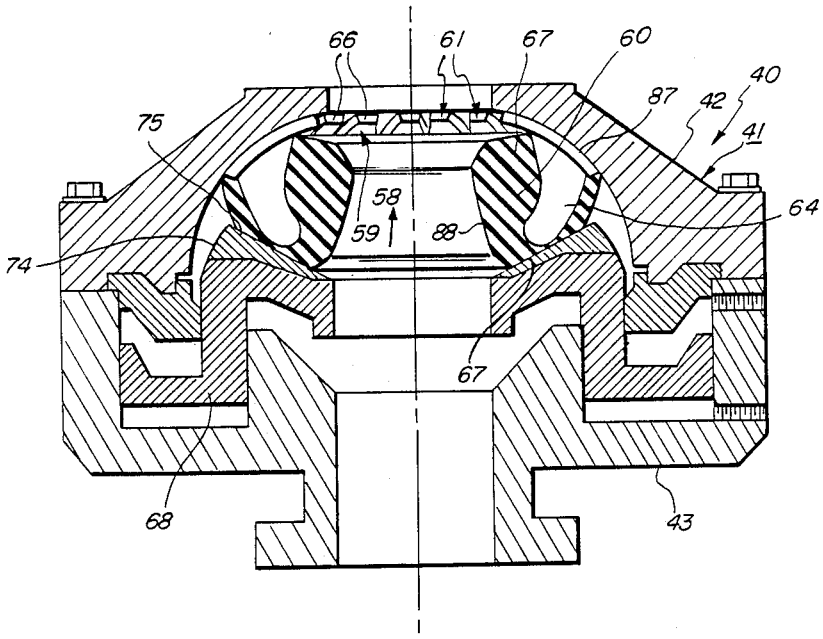
FIG. 7 is a view similar to FIG. 6, but showing the sealing element beginning its travel towards a sealed position.

When the piston 68 is forced upwards a small distance by hydraulic pressure in hydraulic line 84, the sealing element moves from its openmost position, shown in FIG. 6, to a slightly closed position, shown in FIG. 7.

As shown in FIGS. 6 and 7, the sloping upper surface 75 of the piston 68 has a normal directed upwards and inwards towards the longitudinal center line of the apparatus. Thus, upward movement of the piston 68 causes a portion of the resilient matrix 60 between the upper surface of the piston ring 74 and the curved metal teeth 59 of the sealing element 57 to apply an upwards and inwards translation force to the curved metal teeth. At the same time, the compressive pressure on that same portion of the resilient matrix causes its inner cylindrical surface to cold flow inwards, and its outer cylindrical surface to flow outwards, as shown in FIG. 7.

Figure 8:
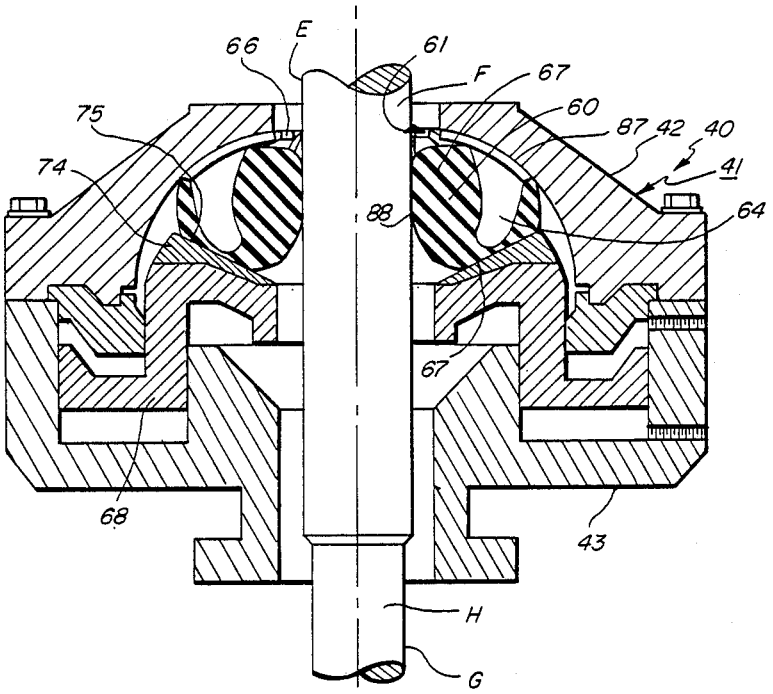
FIG. 8 is a view similar to FIG. 6, but showing the sealing element in sealing peripheral contact with a large diameter drill string component.

FIG. 8 illustrates further upward movement of the piston, which effects sealing contact between the inner circumferential wall surface 88 of sealing element 57 with the outer circumferential surface E of large diameter drill string component F, such as a well casing pipe. As shown in FIG. 8, the downward and inward sloping upper surfaces 75 of the piston ring 74 and, the downward and inward sloping bottom surface 67 of the resilient molded matrix 60, cooperate to cause the matrix to cold flow and form an effective seal to the outer circumferential surface E of the drill string component F.

As shown in FIGS. 6 through 8, the successive upward movement of the piston 68, in cooperation with the beveled piston ring 74 and novel sealing element 57, accomplishes an improved sealing action with the outer circumferential surface of a drill string component. The continuous resilient seal between the lower surface 67 of the molded matrix 60, extending over the beveled upper surface 75 of the piston ring 74 and up along the inner curved surface 87 of the upper housing section 42 to the bottom edge of the upper plate section 61 of curved metal wall 54, provides an effective guard against blowby along those surfaces of gas or liquid, even when the gas or liquid is under great pressure.

Also, the lack of metal-to-metal contact between the piston 68 and the curved metal teeth 59 reduces stresses in the resilient matrix 60, and assures that the narrow upper end "biting" surfaces of the teeth cannot be pushed with potentially damaging force against the outer circumferential surface of a well casing or other large diameter drill string element.

The lack of metal-to-metal contact between the teeth 59 and the piston 68 also minimizes the wear on both the sealing element 57 and drill string components, during the longitudinal movement of drill string components ("stripping") down or up through the bore of the blowout preventer apparatus. Wear is minimized because the teeth 59 are resiliently supported, thereby permitting some freedom of movement of the teeth when the sealing element 57 is contacted by varying diameter drill string components. Thus, wear of metal components and stresses in the resilient matrix 60 are all minimized in the sealing mechanism according to the present invention.

Figure 9:
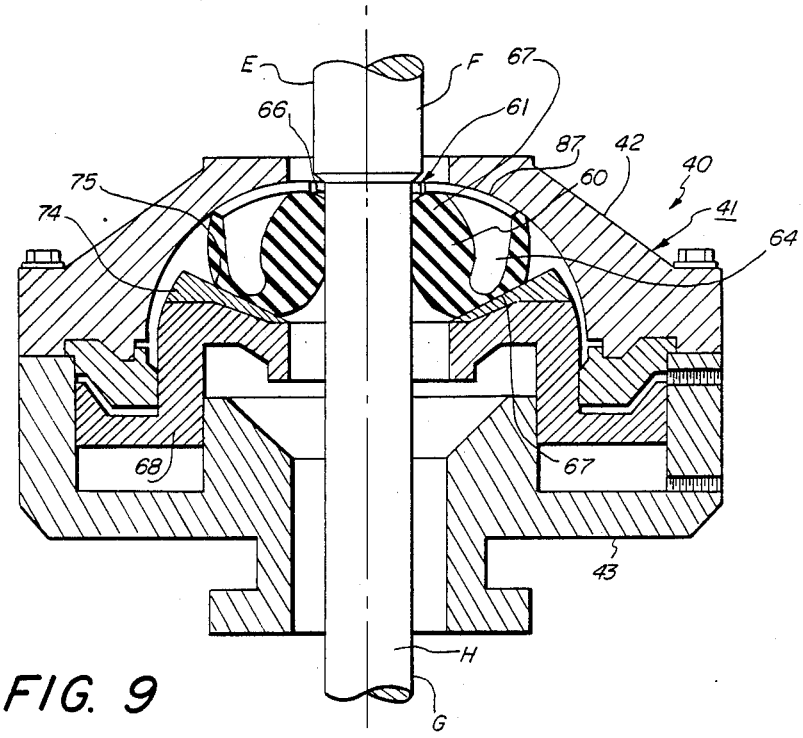
FIG. 9 is a view similar to FIG. 6, but showing the sealing element in sealing peripheral contact with a smaller diameter drill string component.

FIG. 9 illustrates the further upward and inward movement of the sealing element 57 to form an effective seal with the outer circumferential surface G of a smaller diameter drill string component H. FIG. 10 shows the sealing element 57 having traveled to its uppermost vertical position. In FIG. 10, all drill string components have been removed from the apparatus 40, and the inner circumferential wall surfaces 88 of the sealing element 57 are forced into abutting, sealing contact.

FIGS. 11 through 14 illustrate a second embodiment of an oil well blowout preventer sealing device according to the present invention. This embodiment is identical with the basic embodiment of the device described above, save for the structure and internal functions of the sealing mechanism identified by the numeral 57 in the basic embodiment, and by the numeral 97 in this second embodiment.

Figure 14:
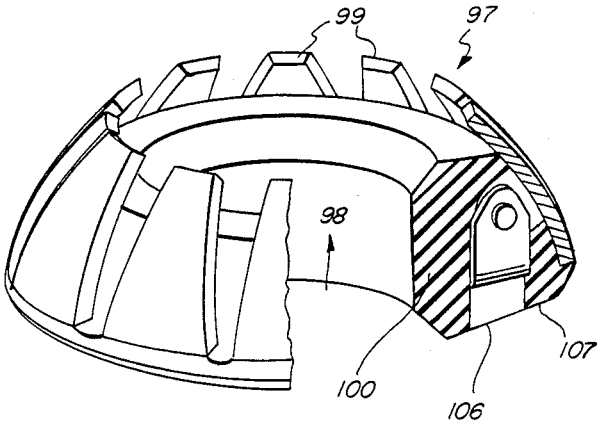
FIG. 14 is a fragmentary perspective view of the sealing element forming part of the apparatus of FIG. 11, with a radial section removed to show its composite structure.

As may be seen best by referring to FIGS. 12 through 14, the sealing element 97 is a composite structure, containing curved metal teeth 99 integrally molded into a generally cylindrical matrix 100 made of a resilient material such as rubber or other elastomer.

As may be seen best by referring to FIG. 12, each curved metal tooth 99 includes an upper section 101 that has in edge view the shape of a curved plate having generally concentric upper and lower surfaces 102 and 103, respectively. A boss or web 104 having the shape of a generally uniform thickness plate projects downwards from the lower surface 103 of the tooth 99. The boss section 104 of the upper section 101 of the tooth 99 is pivotably fastened to a base section 105, in a manner described below. Base section 105 has parallel vertical sides, and a downwardly and inwardly sloping bottom surface 106.

Referring now to FIG. 13, the upper pivotable plate section 101 of each tooth 99 is seen to have in elevation view the general shape of a prism whose side planes and horizontal base plane 115 form an isosceles triangle truncated by an upper truncating plane 116 which truncates the triangle. Also as shown in FIG. 13, the boss or web section 104 has in edge view the shape of a generally uniform thickness plate centered on the altitude of the lower triangular face of 103 of the upper plate section 101 of the tooth, and extending perpendicularly downwards therefrom.

As shown in FIG. 13, the base section 105 of each tooth 99 has in edge view the shape of a yoke having a uniform thickness leg or trunk 117 which Y's into two parallel, uniform thickness upper sections or branches 118. Registered holes 119 are provided through the thickness dimension of the branches 118. A two-headed rivet or pin 120 passes through the holes 119 in the upper branches 118 of the base section 105, and through a hole 121 provided through the thickness dimension of boss 104, which is straddled by opposite branches 118 of the yoke-shaped upper portion of the base section. Thus, as shown in FIGS. 12 and 13, the upper plate section 101 of each tooth 99 is mounted to the base section 105 of the tooth in a manner permitting pivotable motion in a vertical plane of the upper plate section with respect to the base section.

As shown in FIG. 11, the sloping bottom surface 106 of the base section 105 of each tooth 99 of the sealing element 97 is angled to conformally contact the upper surface 75 of piston ring 74 with the piston ring 78 at the bottom of its tread.

As may be seen best by referring to FIGS. 11 and 14, each tooth 99 is retained in the molded resilient matrix 100 at equal circumferential angles, equidistant from the longitudinal center line of the bore 98 through the sealing element 97, thus forming a ring shaped structure having upwardly and inwardly curving outer sides. The resilient matrix 100 has a generally cylindrical shape whose height is less than that of the teeth 99. The base sections 105 of the teeth 99 are completely enclosed within the lower portion of the molded matrix 100, which has a bottom annular wall surface 107 which slopes upwards and outwards from the central bore 98 of the molded matrix. The molded matrix 100 is thus shaped to deform in a controlled manner upon movement of the piston 68 upwards into various sealing positions, similar to those deformations illustrated in FIGS. 6 through 10 for the basic embodiment of the blowout preventer sealing mechanism according to the present invention.

The operation of the second embodiment of the sealing element 97 is similar to the operation of the basic embodiment 57, depicted in FIGS. 6 through 10. In the second embodiment 7, inward and upward movement of the curved metal teeth 99 is more positive than that of teeth 59 of the basic embodiment, since no resilient material is interposed in the path between the piston 68 and the teeth 99. The pivotability of the upper plate section 101 of the teeth 99 with respect to base section 105 in driven contact with the piston 68 provides the flexibility required for the upper plate section 101 of the teeth 99 to follow the hemispherical inside surface of the upper housing section 42 of the blowout preventer. As the base section 105 moves downwardly and inwardly on the sloping upper surface 75 of piston ring 74 with respect to the piston 68, more resilient material is forced inwardly towards the drill string components, thus limiting damage to the drill string components.

The second embodiment 97 of the sealing element provides more positive movement of the rigid components of the sealing element. Also, the inward movement of base section 105 of each tooth 99 as the piston 68 forces the base section upwards forces more of the resilient matrix 100 towards the bore of the sealing element. Thus, the second embodiment 97 of the sealing element is well adapted to high pressure sealing applications.

A third embodiment of an oilwell blowout preventer sealing device according to the present invention is shown in FIGS. 15 through 19. This embodiment is identical with the basic embodiment of the device described above, save for the structure and internal functions of the sealing mechanism identified by the numeral 57 in the basic embodiment, and by the numeral 127 in this third embodiment.

As may be seen best by referring to FIGS. 16 through 19, the sealing element 127 is a composite structure, containing curved metal teeth 129 integrally molded into a generally cylindrical matrix 130 made of a resilient material such as rubber or other elastomer.

Figure 16:
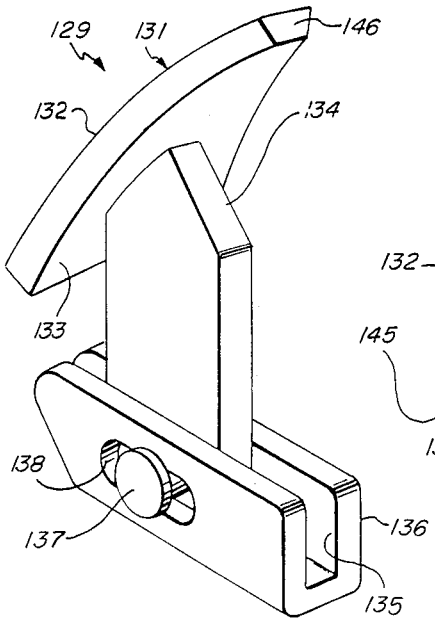
FIG. 16 is an inner perspective view of one of the rigid elements forming part of the sealing element of the device of FIG. 15.
Figure 17:
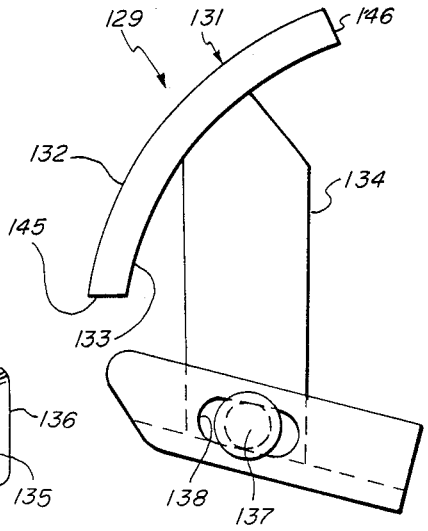
FIG. 17 is a side elevation view of one of the rigid elements forming part of the sealing element of the device of FIG. 16.

As may be seen best by referring to FIGS. 16 and 17, each curved metal tooth 129 includes an upper section 131 that has in edge view the shape of a curved plate having generally concentric upper and lower surfaces 132 and 133, respectively. A web or leg section 134 having the general shape of a vertically elongated, rectangular cross-section bar extends downwards from the lower surface 133 of upper plate section 131 of tooth 129.

Figure 18:
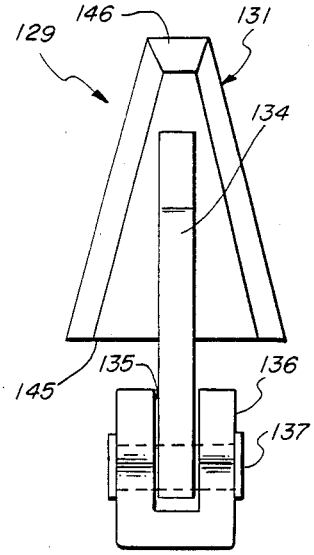
FIG. 18 is an inner edge view of the rigid element of FIGS. 16 and 17.

As shown in FIGS. 16 through 17, and particularly in FIG. 18, the lower end of leg 134 of tooth 129 is slidably supported in an elongated slot 135 provided in the upper surface and running lengthwise of a horizontally elongated, rectangular cross-section base bar 136. The lower end of leg 134 of tooth 139 is slidably confined in the slot 135 by the cooperation of a pin 137 passing through elongated rectangular apertures 138 in opposite sides of the base bar 136 aligned with and communicating with the slot 136.

As shown in FIGS. 16 and 18, the upper plate section 131 of each tooth 129 is seen to have in elevation view the general shape of a prism whose side planes form an isosceles triangle having a horizontal base plane 145 and an upper truncating plane 146 which truncates the triangle.

Figure 15:
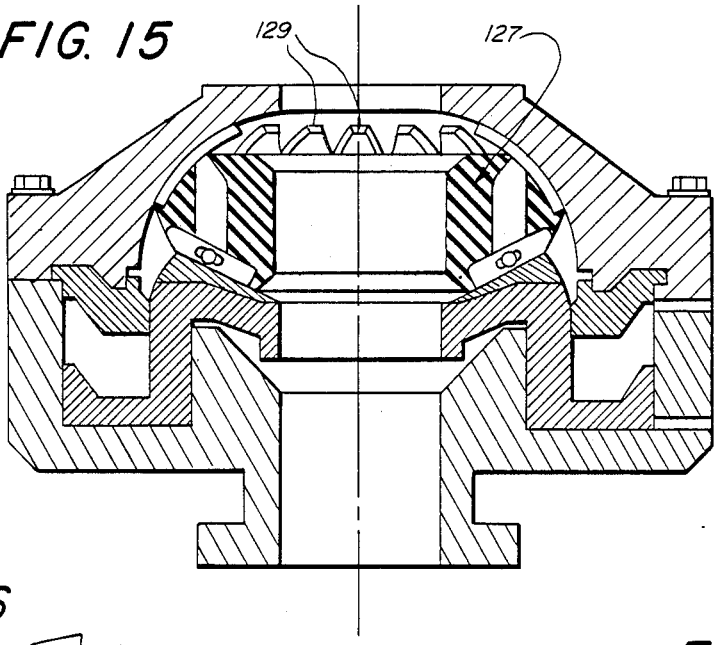
FIG. 15 is a fragmentary longitudinal sectional view of a third embodiment of the oil well blowout preventer device according to the present invention.
Figure 19:
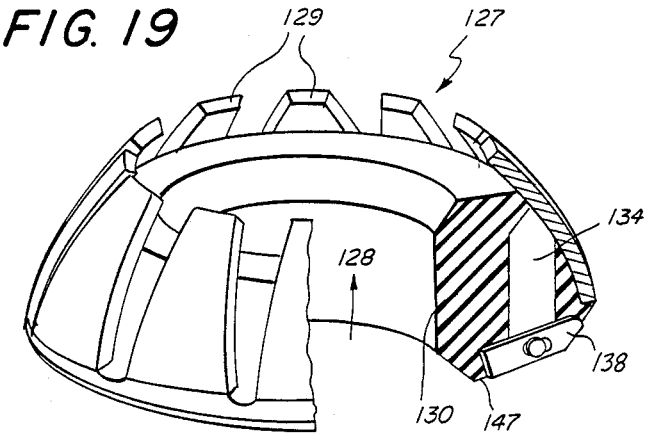
FIG. 19 is a fragmentary perspective view of the sealing element forming part of the apparatus of FIG. 15, with a radial section removed to show the composite structure of the sealing element.
Figure 20:
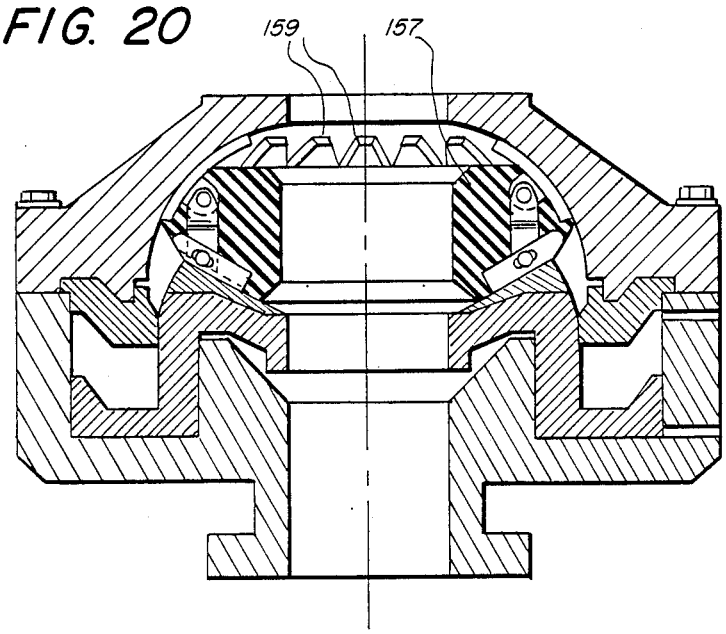
FIG. 20 is a fragmentary longitudinal sectional view of a fourth embodiment of an oil well blowout preventer device according to the present invention.

As may be seen best by referring to FIGS. 15 and 19, each tooth 129 is retained in the molded resilient matrix 130 at equal circumferential angles, equidistant from the longitudinal center line of the bore 128 through the sealing element 127, thus forming a ring shaped structure having upwardly and inwardly curving outer sides. The resilient matrix 130 has a generally cylindrical shape whose height is less than that of the teeth 129. The base bar 136 and leg section 134 of the teeth 129 are completely enclosed within the lower portion of the molded matrix 130, which has a bottom annular wall surface 147 which slopes upwards and outwards from the central bore 128 of the molded matrix. The molded matrix 130 is thus shaped to deform in a controlled manner upon movement of the piston 68 into various sealing positions, similar to those deformations illustrated in FIGS. 6 through 10 for the basic embodiment of the blowout preventer sealing mechanism according to the present invention.

The third embodiment 127 of the sealing element is similar in operation to that of the second embodiment, in the respect that there is no resilient material interposed in the space between the piston 68 and the curved metal teeth 129. In the third embodiment, however, potential damage to drill string components which might occur because of unyielding movement of the curved metal teeth against a drill string component is prevented by the pivotability of the entire upper portion of a tooth with respect to the base bar 136 of the tooth about the axis of pivot pin 137, and by the slidability of the leg or web section 134 of a tooth with respect to the base bar. The large plan-view cross sectional area of the base 136 is effective in applying an upward and inward sealing force to a larger portion of the resilient matrix 130 than the first two embodiments.

A fourth embodiment of oilwell blowout preventer sealing device according to the present invention is shown in FIGS. 20 through 23. This fourth embodiment is identical to the basic embodiment described above, save for the sealing element 157.

Figure 21:
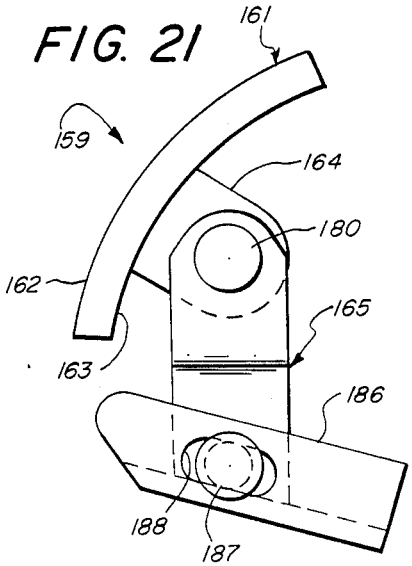
FIG. 21 is a side elevation view of one of the rigid elements forming part of the sealing element of the device of FIG. 20.
Figure 22:
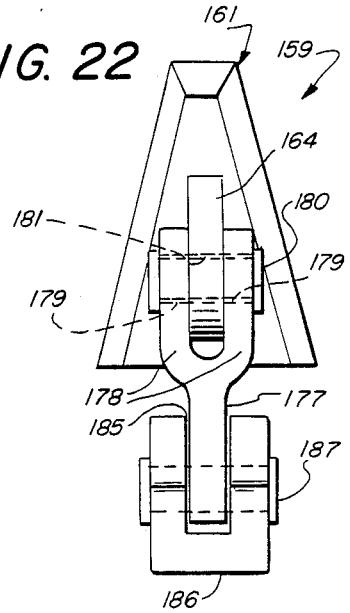
FIG. 22 is an inner edge view of the rigid element of FIG. 21.
Figure 23:
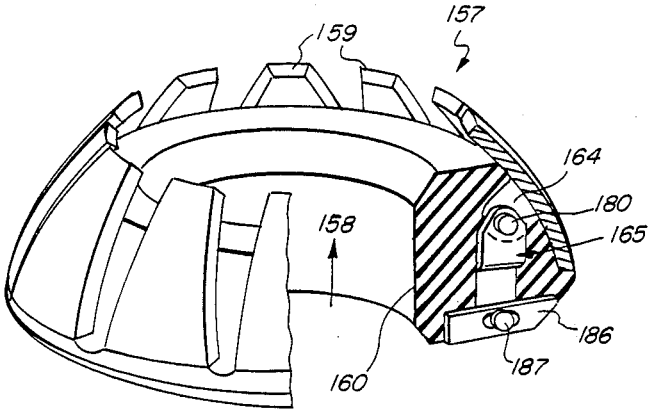
FIG. 23 is a fragmentary perspective view of the sealing element forming part of the apparatus of FIG. 20, with a radial section removed to show the composite structure of the sealing element.
Figure 24:
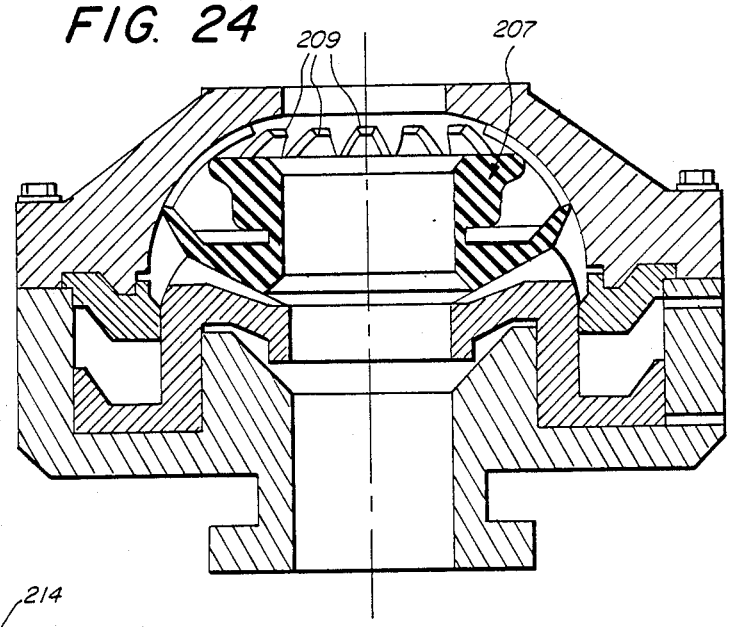
FIG. 24 is a fragmentary longitudinal sectional view of a fifth embodiment of an oil well blowout preventer device according to the present invention.
Figure 25:
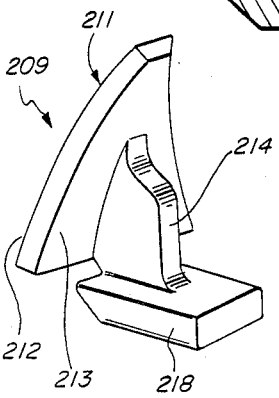
FIG. 25 is an inner perspective view of one of the rigid elements comprising the sealing element of the device of FIG. 24.
Figure 26:
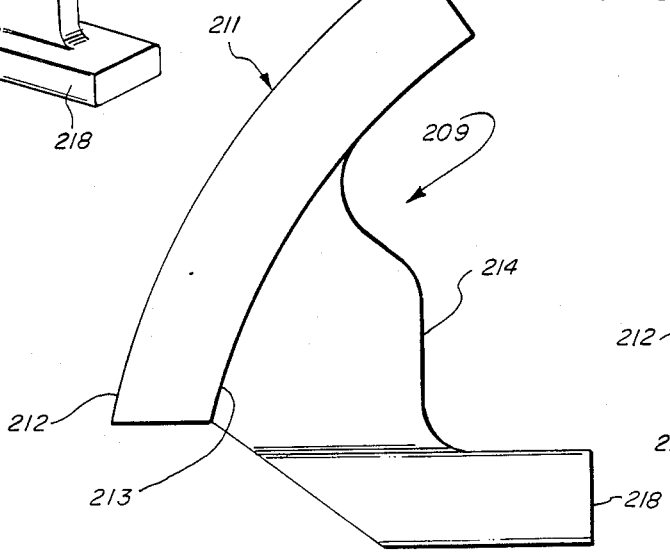
FIG. 26 is a side elevation view of one of the rigid elements of FIG. 25.
Figure 27:
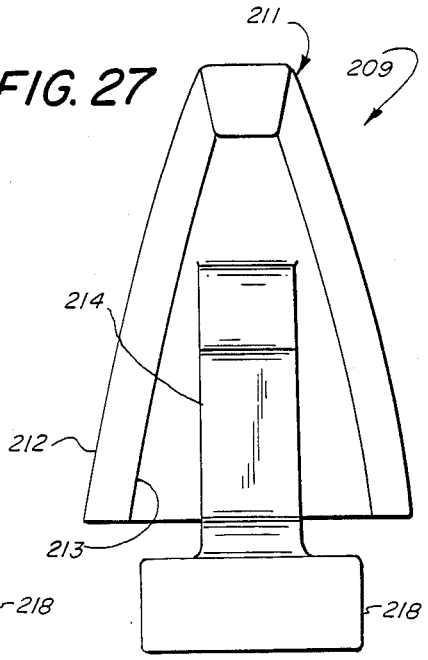
FIG. 27 is an inner edge view of the rigid element of FIGS. 25 and 26.

As shown in FIGS. 20 through 23, the lower portion of the sealing element 157 is identical to the sealing element 127 used in the third embodiment, described above. However, the upper plate section 161 of each metal tooth 159 of sealing element 157 is pivotably supported at the upper end of a forked base section, similar to the arrangement of the upper portion of the teeth 99 of the sealing element 97 of the second embodiment of the invention. Thus, as shown in FIGS. 21 and 22, each tooth 159 has a boss or web section 164 projecting downwards from the lower surface 163 of the upper plate section 161 of the tooth.

As shown in FIG. 22, the base section 156 of each tooth 159 has in edge view the shape of a uniform thickness leg or trunk section 177 which Y's into two parallel, uniform thickness upper sections or branches 178. Registered holes 179 are provided through the thickness dimension of the branches 178. A two-headed rivet or pin 180 passes through the holes 179 in the upper branches 178 of the base section 165, and through a hole 181 provided through the thickness dimension of boss 164, which is straddled by opposited branches 178 of the yoke-shaped, upper portion of the base section. Thus, as shown in FIGS. 21 and 22 each tooth 159 is mounted in the base section 165 of the tooth in a manner permitting pivotable motion in a vertical plane of the upper plate section with respect to the base section. This pivotability is in addition to the pivotability and slidability of the lower base portion of the base section 164 with respect to the slotted base bar 186. The additional degrees of freedom afforded by the pivotability of the upper plate section 161 of the teeth 159 affords additional protection against damaging impact of the teeth with drill string components.

FIGS. 24 through 27 illustrate a fifth embodiment of the blowout preventer mechanism according to the present invention. This embodiment is identical with the basic embodiment of the device described above, save for the structure and operation of the sealing mechanism identified by the numeral 57 in the basic embodiment, and by the numeral 207 in this fifth embodiment.

As shown in the FIGS. 24 through 27, the sealing element 207 is substantially similar in appearance to the sealing element 57 of the basic embodiment. However, each tooth 209 of sealing element 207 has a block-shaped foot section 218 disposed perpendicularly to the lower end of leg or web section 214 of the tooth. The function of foot section 218 is to provide a larger cross sectional area effective in applying an upward and inward sealing force to the resilient matrix 210.

A sixth embodiment of the invention is shown in FIGS. 29 through 31.

As may be seen best by referring to FIGS. 29, 30 and 31, the sixth embodiment of the oil well blowout preventer device according to the present invention is identical with the second embodiment, save for differences between the sealing element 227 of the sixth embodiment and the sealing element 97 of the second embodiment.

As shown in FIGS. 30 and 31, the curved metal teeth 229 of the sealing element 227 are similar to the curved metal teeth 99 of the second embodiment, shown in FIGS. 12 and 13. Each of the other parts of the sealing element 227 identical to corresponding elements of the sealing element 97, with the number for the corresponding part of sealing element 227 given by adding 130 to its corresponding part in sealing element 97.

As shown in FIGS. 30 and 31, each of the curved metal teeth 229 corresponding to teeth 99 in FIGS. 12 and 13 is modified by the addition of a rectangular block-shaped foot 252 to the bottom sloping surface 236 of base section 235 of tooth 229. The larger cross-sectional area of the block-shaped foot 252 affords a more effective transfer of upward longitudinal force from the piston 68 as it moves upward in contact with the resilient matrix then is possible without the foot. Also, the inner, generally vertically oriented face 253 of the blockshaped foot affords a more effective transfer of a radially inward force component from the piston 68 as it moves upward, effecting a more effective sealing pressure of the lower portion of the molded resilient matrix against drill string components.

What is claimed is:

1. An oil well blowout preventer comprising:

a. a housing having an entrance bore, a coaxially aligned lower exit bore, and a generally circularly symmetric curved hollow upper interior cavity coaxial with and communicating with said entrance and exit bores, said housing being adapted to receiver drill string components coaxially through said bores, b. a sealing member moveable longitudinally and radially within the interior of said housing, said sealing member being a composite structure having a plurality of incompressible elements imbedded in a resilient matrix of generally circularly symmetric shape, the dimensions of said matrix being of such relationship to the inner wall dimensions of said cavity of said housing as to form a space between said matrix and said cavity walls for any longitudinal position of said sealing member in said cavity thereby permitting movement of a portion of said resilient matrix into said space, and thereby limiting the force with which said sealing member may impact said drill string components within said housing, and c. actuating means for effecting longitudinal and radial movement of said sealing member.

2. The device of claim 1 wherein said sealing member is further defined as having a lower annular wall surface which slopes downwards and inwards towards the common longitudinal center line of said entrance and exit bores.

3. The device of claim 2 wherein said actuating means for causing longitudinal and radial movement of said sealing member is further defined as comprising a piston coaxial with said common center line of said housing and movable axially therewithin, said piston having a hollow central coaxial bore and said piston having in its upper face an upper annular area beveled downwards and inwards towards the longitudinal center line of said piston, said upper annular area of said piston being of the proper shape to slidingly engage substantially the entire lower annular wall surface of said sealing member.

4. The device of claim 3 wherein said piston has an annular flange section extending radially outwards from the cylindrical wall of said piston, the annular surfaces of said flange section of said piston being adapted to converting fluid pressure thereon into axial movement of said piston.

5. The device of claim 1 wherein each of said incompressible elements of said sealing member have at least two parts moveable with respect to one another.

6. The device of claim 5 wherein said parts of said incompressible sealing elements are pivotable with respect to one another.

7. The device of claim 5 wherein said parts of said incompressible sealing elements are translatable with respect to one another.

8. The device of claim 5 wherein said parts are pivotable and translatable with respect to one another.

9. An oil well blowout prevent comprising:

a. a housing having a generally centrally located entrance bore, a coaxially aligned exit bore, and a generally circularly symmetric curved hollow interior cavity coaxial with and communicating with said entrance and exit bores, said housing being adapted to receive drill string components coaxially through said bores, b. a sealing member of generally circularly symmetric shape moveable longitudinally and radially within said curved hollow interior cavity into sealing circumferentially contact with the circumferential surfaces of said drill string components or the inner facing radial surfaces of said sealing element, said sealing member being a composite structure having a plurality of incompressible elements imbedded in a resilient matrix, the dimensions of said matrix being of such relationship to the inner wall dimensions of said housing as to form a space between said matrix and said cavity walls for any longitudinal position of said sealing member in said cavity, thereby permitting movement of a portion of said resilient matrix into said space and thereby limiting the radial compressive force exertable by said sealing member, and c. actuating means for effecting longitudinal and radial movement of said sealing member within said curved hollow interior cavity.

10. The device of claim 9 wherein said sealing member is further defined as having a generally cylindrical resilient matrix having a hollow coaxial central bore, said matrix holding incompressible elements spaced at regular circumferential angles around the central bore at equal radial distances therefrom, said incompressible elements each having a curved tooth-like upper plate section extending upwards and curving inwards toward said hollow central bore, each of said tooth-like upper plate sections having a radially inwardly and downwardly depending web section molded into said resilient matrix, said resilient matrix having a bottom annular region underlying to a lower altitude the lower outer edge of each tooth-like upper plate section.

11. The device of claim 10 wherein said resilient matrix of said sealing element is further defined as extending radially inwards beyond said incompressible elements, whereby the inner walls of said hollow central bore are comprised entirely of resilient material.

12. The device of claim 11 wherein said resilient matrix of said sealing element is further defined as having an altitude of less than the altitude of the upper edges of said tooth-like upper plate sections of said incompressible elements.

13. The device of claim 12 wherein said resilient matrix of said sealing element is further defined as having a bottom annular wall surface which slopes downwards and inwards toward the central bore of said resilient matrix, thereby adapting said sealing element to be driven upwards by a hollow, coaxially aligned piston having a downwardly an inwardly beveled upper annular wall surface.

14. The device of claim 13 wherein said actuating means for effecting longitudinal and radial movement of said sealing member is further defined as comprising a piston coaxial with said common center line of said housing and moveable axially therewithin, said piston having a hollow central coaxial bore and said piston having in its upper face an upper annular area beveled downwards and inwards towards the longitudinal center line of said piston, said upper annular area of said piston being of the proper shape to slidingly engage substantially the entire lower annular wall surface of said sealing member.

15. The device of claim 13 wherein said web section of each of said incompressible elements of said sealing member is further defined as a generally uniform thickness curved leg-like plate extending perpendicularly downwards and inwards from the bottom surface of said tooth-like upper plate section, said web section being encapsulated by resilient material of said resilient matrix.

16. The device of claim 13 wherein said incompressible elements of said sealing member are each further defined as having:

a. a tooth-like upper plate section having in cross section the shape of a triangle, b. a relatively short boss or web section projecting centrally and perpendicularly downwards from the lower surface of the upper plate section, and c. an elongated bar-like leg section pivotably fastened at its upper end to said boss section, the lower surface of said leg section sloping downwards and inwards towards the central bore of said resilient matrix, thereby adapting said leg section to be driven upwards by a contacting hollow, coaxially aligned piston having a downwardly and inwardly beveled upper annular wall surface.

17. The device of claim 13 wherein said incompressible elements of said sealing member are each further defined as having:

a. a tooth-like upper plate section having in cross section the shape of a truncated triangle, b. a web or leg section having the shape of a vertically elongated, flat-sided bar projecting centrally and perpendicularly downwards from the lower surface of the upper plate section, the lower surface of said leg section sloping downwards and inwards towards the central bore of said resilient matrix, c. a foot or base section in the form of a rectangular plan view bar, said bar having a longitudinally disposed slot cut downwards from its upper face for slidably receiving the lower end of said leg section, and d. means for vertically pivotably and radially slidably securing said leg section to said foot section.

18. The device of claim 17 further comprising means for providing vertical pivotability of said tooth-like upper plate section with respect the upper end of said leg section.

19. The device of claim 13 wherein said incompressible elements of said sealing member are each further defined as having;

a. a tooth-like upper plate section having in cross section the shape of a truncated triangle, b. a web or leg section having the shape of a vertically elongated, flat-sided, trapezoidal cross-section bar projecting centrally and perpendicularly downwards from the lower surface of the upper plate section, the lower surface of said leg section lying in a plane perpendicular to said central bore of said sealing element, and c. a foot or base section in the form of a rectangular plan view bar, said bar being joined perpendicularly at its upper large face to the lower end of said leg section.

20. The device of claim 13 wherein said incompressible elements of said sealing members are each further defined as having:

a. a tooth-like upper plate section having in cross section the shape of a truncated triangle, b. a relatively short boss or web section projecting centrally and perpendicularly downwards from the lower surface of the upper plate section, c. an elongated bar-like leg section pivotably fastened at its upper end to said boss section, the lower surface of said leg section sloping downwards and inwards towards the central bore of said resilient matrix, and d. a foot or base section in the form of a rectangular plan view bar, said bar being joined perpendicularly at its upper large face to the lower sloped end of said leg section, thereby adapting the large lower face of said foot section to be driven by a contacting hollow, coaxially aligned piston having a downwardly and inwardly beveled upper annular wall surface.

21. A sealing member for oil well blowout preventers of the type having a housing including an entrance bore, a coaxially aligned exit bore, and a generally circularly symmetric curved hollow interior cavity coaxial with and communicating with said entrance and exit bores, said housing being adapted to receive drill string components coaxially through said entrance and exit bores, and said sealing member having a generally circularly symmetric shape and hollow central bore and adapted to move longitudinally and radially within said curved hollow interior cavity into sealing circumferential contact with the circumferential surfaces of said drill string components or the inner facing radial surfaces of said sealing member, said sealing member being a composite structure having a plurality of incompressible elements imbedded in a resilient matrix, the dimensions of said matrix being being of such relationship to the inner wall dimensions of said cavity of said housing as to from a space between said matrix and said cavity walls for any longitudinal position of said sealing member in said cavity, thereby permitting movement of a portion of said resilient matrix into said space, and thereby limiting the radial compressive force exertable by said sealing member.

22. The device of claim 21 wherein said sealing element is further defined as having a generally cylindrical resilient matrix having a hollow coaxial central bore, said matrix holding incompressible elements spaced at regular circumferential angles around the central bore at equal radial distances therefrom, said incompressible elements each having a curved tooth-like upper plate section extending upwards and curving inwards toward said hollow central bore, each of said tooth-like upper plate sections having a radially inwardly and downwardly depending web section molded into said resilient matrix, said resilient matrix having a bottom annular region underlying to a lower altitude the lower outer edge of each tooth-like upper plate section.

23. The device of claim 22 wherein said resilient matrix of said sealing element is further defined as extending radially inwards beyond said incompressible elements, whereby the inner walls of said hollow neutral bore are comprised entirely of resilient material.

24. The device of claim 23 wherein said resilient matrix of said sealing element is further defined as having an altitude of less than the altitude of the upper edges of said tooth-like upper plate sections of said incompressible elements.

25. The device of claim 24 wherein said resilient matrix of said sealing element is further defined as having a bottom annular wall surface which slopes downwards and inwards towards the central bore of said resilient matrix, thereby adapting said sealing element to be driven upwards by a hollow, coaxially aligned piston having a downwardly and inwardly beveled upper annular wall surface.

26. The device of claim 25 wherein said web section of said incompressible elements of said sealing member is further defined as a curved leg-like plate extending perpendicular downwards and inwards from the bottom surface of said tooth-like upper plate section, said web section being encapsulated by resilient material of said resilient matrix.

27. The device of claim 25 wherein said incompressible elements of said sealing member are each further defined as having:

a. a tooth-like upper plate section having in cross section the shape of a triangle, b. a relatively short boss or web section projecting centrally and perpendicularly downwards from the lower surface of the upper plate section, and c. an elongated bar-like leg section pivotably fastened at its upper end to said boss section, the lower surface of said leg section sloping downwards and inwards towards the central bore of said resilient matrix, thereby adapting said leg section to be driven upwards by a contacting hollow, coaxially aligned piston having a downwardly and inwardly beveled upper annular wall surface.

28. The device of claim 25 wherein said incompressible elements of said sealing member are each further defined as having:

a. a tooth-like upper plate section having in cross section the shape of a truncated triangle, b. a web or leg section having the shape of a vertically elongated, flat-sided bar projecting centrally and perpendicularly downwards from the lower surface of the upper plate section, the lower surface of said leg section sloping downwards and inwards towards the central bore of said resilient matrix, c. a foot or base section in the form of a rectangular plan view bar, said bar having a longitudinally disposed slot cut downwards from its upper face for slidably receiving the lower end of said leg section, and d. means for vertically pivotably and radially slidably securing said leg section to said foot section.

29. The device of claim 28 further comprising means for providing vertical pivotability of said tooth-like upper plate section with respect to the upper end of said leg section.

30. The device of claim 25 wherein said incompressible elements of said sealing member are each further defined as having;

a. a tooth-like upper plate section having in cross section the shape of a truncated triangle, b. a web or leg section having the shape of a vertically elongated, flat-sided, trapezoidal cross section bar projecting centrally and perpendicularly downwards from the lower surface of the upper plate section, the lower surface of said leg section lying in a plane perpendicular to said central bore of said sealing element, and c. a foot or base section in the form of a rectangular plan view bar, said bar being joined perpendicularly at its upper large face to the lower end of said leg section.

31. The device of claim 25 wherein aid incompressible elements of said sealing members are each further defined as having;

a. a tooth-like upper plate section having in cross section the shape of a truncated triangle, b. a relatively short boss or web section projecting centrally and perpendicular downwards from the lower surface of the upper plate section, c. an elongated bar-like leg section pivotally fastened at its upper end to said boss section, the lower surface of said leg section sloping downwards and inwards towards the central bore of said resilient matrix, and d. a foot or base section in the form of a rectangular plan view bar, said bar being joined perpendicularly at its upper large face to the lower sloped end of said leg section, thereby adapting the large lower face of said foot section to be driven by a contacting hollow, coaxially aligned piston having a downwardly and inwardly beveled upper annular wall surface.

* * * * *